US005281346A

United States Patent [19]

Adams et al.

[11] Patent Number: 5,281,346

[45] Date of Patent: Jan. 25, 1994

[54] TWO-CYCLE ENGINE LUBRICANT AND METHOD OF USING SAME COMPRISING ALKALI OR ALKALINE EARTH METAL SALTS OF CARBOXYLIC AROMATIC ACIDS

[75] Inventors: Paul E. Adams, Willoughby Hills; William K. S. Cleveland, Mentor on the Lake; Sheri L. Blystone, Concord Township, all of Ohio

[73] Assignee: The Lubrizol Corporation, Wickliffe, Ohio

[21] Appl. No.: 869,690

[22] Filed: Apr. 16, 1992

[51] Int. Cl.[5] ..... C10M 129/38; C10M 129/40; C10L 1/18

[52] U.S. Cl. ..... 252/38; 252/33; 252/33.2; 252/33.6; 252/36; 252/37.7; 252/39; 252/40; 252/41; 44/363; 44/389; 44/390; 44/391; 44/398; 44/403; 44/405; 44/410

[58] Field of Search ..... 252/33, 33.2, 33.6, 252/36, 37.7, 39, 40, 41, 38; 44/363, 389, 390, 391, 398, 403, 405, 410

[56] References Cited

U.S. PATENT DOCUMENTS

| | | | |
|---|---|---|---|
| 2,197,834 | 4/1940 | Reiff et al. | 87/9 |
| 2,197,836 | 4/1940 | Reiff et al. | 252/37.7 |
| 2,198,274 | 4/1940 | Reiff et al. | 252/37.7 |
| 2,198,292 | 4/1940 | Reiff et al. | 252/37.7 |
| 2,263,445 | 11/1941 | Reiff et al. | 252/37.7 |
| 2,380,305 | 7/1945 | Gleason et al. | 252/57 |
| 2,776,260 | 1/1957 | Klicker et al. | 252/37.7 |
| 2,933,520 | 4/1960 | Bader | 260/473 |
| 3,038,935 | 6/1962 | Gerber et al. | 260/935 |
| 3,133,944 | 5/1964 | Christenson | 260/434 |
| 3,385,792 | 5/1968 | Morway | 252/33.6 |
| 3,471,537 | 10/1969 | Berke et al. | 260/429 |
| 3,471,554 | 10/1969 | Holmen | 260/520 |
| 3,723,489 | 3/1973 | Dexter et al. | 260/429.7 |
| 3,954,808 | 5/1976 | Elliott et al. | 260/486 |
| 3,966,807 | 6/1976 | Elliott et al. | 260/559 |
| 4,046,802 | 9/1977 | Elliott et al. | 560/61 |
| 4,051,049 | 9/1977 | Elliott et al. | 252/51.5 A |
| 4,083,791 | 4/1978 | Elliott et al. | 252/51.5 A |
| 4,263,167 | 4/1981 | Mago | 252/391 |
| 4,425,138 | 1/1984 | Davis | 44/58 |
| 4,611,016 | 9/1986 | Hinsken et al. | 529/99 |
| 4,708,809 | 11/1987 | Davis | 252/33.4 |
| 4,740,321 | 4/1988 | Davis et al. | 252/33.4 |
| 4,828,733 | 5/1989 | Farng et al. | 252/42.7 |
| 4,855,073 | 8/1989 | Murakami et al. | 252/39 |

FOREIGN PATENT DOCUMENTS

| | | |
|---|---|---|
| 1446435 | 8/1976 | United Kingdom . |
| 8904358 | 5/1989 | World Int. Prop. O. . |

*Primary Examiner*—Jerry D. Johnson
*Attorney, Agent, or Firm*—Joseph P. Fischer; Frederick D. Hunter; James L. Cordek

[57] ABSTRACT

This invention relates to lubricants for two-cycle engines comprising a major amount of at least one oil of lubricating viscosity and a minor amount of at least one compound of the general formula $$A^{y-}M^{y+} \quad \text{(I)}$$

wherein M represents one or more metal ions, y is the total valence of all M and A represents one or more anion containing groups having a total of about y individual anionic moieties and each anion containing group is a group of the formula (II)

wherein T is selected from the group consisting of (Abstract continued on next page.)

ABSTRACT
-continued
(V)
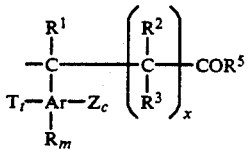
or
-continued
(VI)
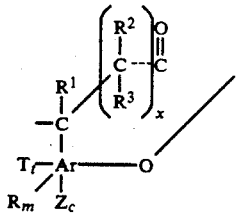
Additive concentrates and lubricant-fuel mixtures for two cycle engines are also disclosed as well as methods for operating two-cycle engines.
80 Claims, No Drawings

TWO-CYCLE ENGINE LUBRICANT AND METHOD OF USING SAME COMPRISING ALKALI OR ALKALINE EARTH METAL SALTS OF CARBOXYLIC AROMATIC ACIDS

FIELD OF THE INVENTION

This invention relates to lubricant compositions and fuel-lubricant mixtures useful in two-cycle engines. More particularly, it relates to lubricant compositions containing a major amount of an oil of lubricating viscosity and a minor amount of at least one metal carboxylate as described in greater detail hereinbelow.

BACKGROUND OF THE INVENTION

Over the past several decades the use of spark-ignited two-cycle (2-stroke) internal combustion engines has steadily increased. They are presently found in power lawn mowers and other power-operated garden equipment, power chain saws, pumps, electrical generators, marine outboard engines, snowmobiles, motorcycles and the like. Two-cycle engines have found limited application as automobile and truck engines. Manufacturers are exploring how to expand this use.

The increasing use of two-cycle engines coupled with increasing severity of the conditions in which they have operated has led to an increased demand for oils to adequately lubricate such engines and which provide enhanced performance. Among the problems associated with two-cycle engines are piston ring sticking, piston scuffing, rusting, lubrication related failure of connecting rod and main bearings and the general formation on the engine's interior surfaces of carbon and varnish deposits. Piston ring sticking is a particularly serious problem. Ring sticking leads to failure of the sealing function of piston rings. Such sealing failure causes loss of cylinder compression which is particularly damaging in two-cycle engines because these engines depend on suction to draw the new fuel charge into the exhausted cylinder. Thus, ring sticking can lead to deterioration in engine performance and unnecessary consumption of fuel and/or lubricant Other problems associated with two-cycle engines include piston lubricity, scuffing or scoring.

All of the aforementioned problems associated with two-cycle engines must be adequately addressed Improved performance is continually being sought. The unique problems and techniques associated with the lubrication of two-cycle engines has led to the recognition by those skilled in the art of two-cycle engine lubricants as a distinct lubricant type. See, for example, U.S. Pat. Nos. 3,085,975; 3,004,837; and 3,753,905.

The compositions of the present invention are effective in controlling the aforementioned problems.

While color, per se, is not often a consideration when evaluating performance of a 2-cycle engine lubricant, it may be a consideration for other reasons.

As is well-known, the equipment operator frequently prepares lubricant-fuel blends. A particularly dark colored lubricant or one that imparts a significant color to the lubricant-fuel blend, while not affecting performance, may be deemed to be objectionable. Furthermore, two-cycle oils frequently contain a small amount of dye, to impart a characteristic color to the lubricant-fuel blend. If the color of the lubricant is pronounced, it may mask the color of the dyed fuel or may lead the user to believe that the lubricant-fuel blend has deteriorated.

The lubricating compositions of the instant invention are considerably lighter in color than many commercially available lubricants.

U.S. Pat. No. 4,425,138 relates to amino phenols used in lubricant fuel mixtures for two-cycle engines U.S. Pat. Nos. 4,663,063 and 4,724,091 issued to Davis relate to a combination of an alkyl phenol and an amino compound in two-cycle engines.

U.S. Pat. Nos. 4,708,809 and 4,740,321 relate to use of alkylated phenols in two-cycle engine lubricants. U.S. Pat. No. 4,231,757 relates to nitrophenol-amine condensates and the use thereof in two cycle oils.

SUMMARY OF THE INVENTION

This invention relates to a lubricant for two-cycle engines comprising a major amount of at least one oil of lubricating viscosity and a minor amount of at least one compound of the general formula $$A^{y-}M^{y+} \qquad \text{(I)}$$

wherein M represents one or more metal ions, y is the total valence of all M and A represents one or more anion containing groups having a total of about y individual anionic moieties and each anion containing group is a group of the formula (II)

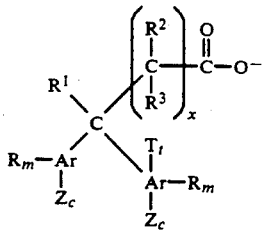

wherein T is selected from the group consisting of (V)

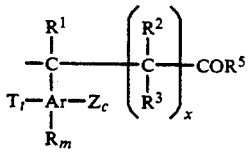

or (VI)

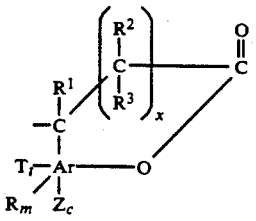

wherein each $R^5$ is independently selected from $O^-$ and $OR^6$ wherein $R^6$ is H or alkyl and each t is independently 0 or 1, wherein T is as hereinbefore defined and wherein each Ar is independently an aromatic group of from 4 to about 30 carbon atoms having from 0 to 3 optional substituents selected from the group consisting of polyalkoxyalkyl, lower alkoxy, nitro, halo or combinations of two or more of said optional substituents, or an analog of such an aromatic group, each R is independently a hydrocarbyl group, $R^1$ is H or a hydrocarbyl group, $R^2$ and $R^3$ are each independently H or a hydrocarbyl group, each m is independently 0 or an integer ranging from 1 to about 10, x ranges from 0 to about 8, and each Z is independently OH, $(OR^4)_bOH$ or O− wherein each $R^4$ is independently a divalent hydrocarbyl group and b is a number ranging from 1 to about 30 and c ranges from 0 to about 3 with the proviso that when t in Formula (II)=0, or when T is Formula (V), then c is not 0, provided that the sum of m, c and t does not exceed the unsatisfied valences of the corresponding Ar.

Since lubricant compositions for two-cycle engines are often mixed with fuels before or during combustion, this invention also includes fuel-lubricant mixtures. Also included within the scope of this invention are methods for operating two-cycle engines employing the lubricants and lubricant-fuel mixtures of this invention.

Therefore, it is an object of this invention to provide novel lubricants and fuel-lubricant mixtures for two-cycle engines.

Another object is to provide improved lubricants and fuel-lubricant mixtures for two-cycle engines.

It is a further object of this invention to provide novel means for lubricating two-cycle engines.

Other objects will be apparent to those skilled in the art upon review of the present specification.

DESCRIPTION OF THE PREFERRED EMBODIMENTS DETAILED DESCRIPTION OF THE INVENTION

As mentioned hereinabove, the present invention relates to a lubricant for two-cycle engines comprising a major amount of at least one oil of lubricating viscosity and a minor amount of at least one compound of the general formula $$A^{y-}M^{y+}$$

wherein M represents one or more metal ions, y is the total valence of all M and A represents one or more anion containing groups having a total of about y individual anionic moieties.

The Anion-Containing Group

A represents one or more anion containing groups having a total of about y individual anionic moieties and each anion containing group is a group of the formula (II)

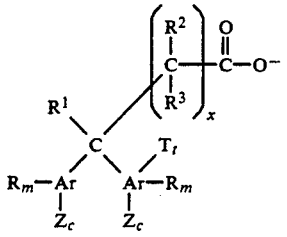

wherein T is selected from the group consisting of (V)

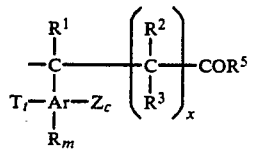

or (VI)

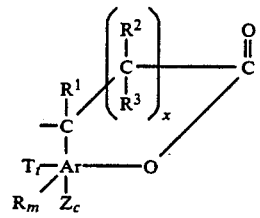

wherein each $R^5$ is independently selected from O− and $OR^6$ wherein $R^6$ is H or alkyl and each t is independently 0 or 1, wherein T is as hereinbefore defined and wherein each Ar is independently an aromatic group of from 4 to about 30 carbon atoms having from 0 to 3 optional substituents selected from the group consisting of polyalkoxyalkyl, lower alkoxy, nitro, halo or combinations of two or more of said optional substituents, or an analog of such an aromatic nucleus, each R is independently a hydrocarbyl group, $R^1$ is H or a hydrocarbyl group, $R^2$ and $R^3$ are each independently H or a hydrocarbyl group, each m is independently zero or an integer ranging from 1 to about 10, x ranges from 0 to about 6, and each Z is independently OH, $(OR^4)_bOH$ or O− wherein each $R^4$ is independently a divalent hydrocarbyl group and b is a number ranging from 1 to about 30 and c ranges from 0 to about 3 with the proviso that when t in Formula (II)=0, or when T is Formula (V), then c is not 0, provided that the sum of m, c and t does not exceed the unsatisfied valences of the corresponding Ar.

The aromatic group Ar of formula (II) can be a single aromatic nucleus such as a benzene nucleus, a pyridine nucleus, a thiophene nucleus, a 1,2,3,4-tetrahydronaphthalene nucleus, etc., or a polynuclear aromatic moiety. Such polynuclear moieties can be of the fused type; that is, wherein pairs of aromatic nuclei making up the Ar group share two points, such as found in naphthalene, anthracene, the azanaphthalenes, etc. Polynuclear aromatic moieties also can be of the linked type wherein at least two nuclei (either mono or polynuclear) are linked through bridging linkages to each other. Such bridging linkages can be chosen from the group consisting of carbon-to-carbon single bonds between aromatic nuclei, ether linkages, keto linkages, sulfide linkages, polysulfide linkages of 2 to 6 sulfur atoms, sulfinyl linkages, sulfonyl linkages, methylene linkages, alkylene linkages, di-(lower alkyl) methylene linkages, lower alkylene ether linkages, alkylene keto linkages, lower alkylene sulfur linkages, lower alkylene polysulfide linkages of 2 to 6 carbon atoms, amino linkages, polyamino linkages and mixtures of such divalent bridging linkages. In certain instances, more than one bridging linkage can be present in Ar between aromatic nuclei. For example, a fluorene nucleus has two benzene nuclei linked by both a methylene linkage and a covalent bond Such a nucleus may be considered to have 3 nuclei but only two of them are aromatic. Normally, Ar will contain only carbon atoms in the aromatic nuclei per se.

Specific examples of single ring Ar moieties are the following:

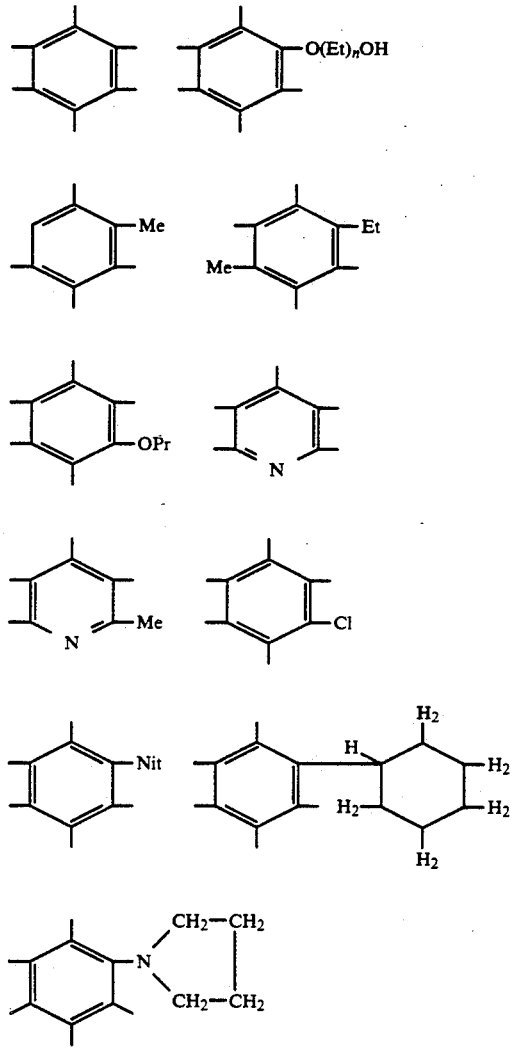

etc., wherein Me is methyl, Et is ethyl or ethylene, as appropriate, Pr is n-propyl, and Nit is nitro.

Specific examples of fused ring aromatic moieties Ar are:

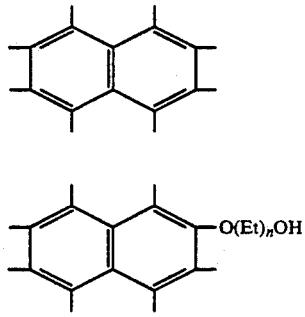

-continued

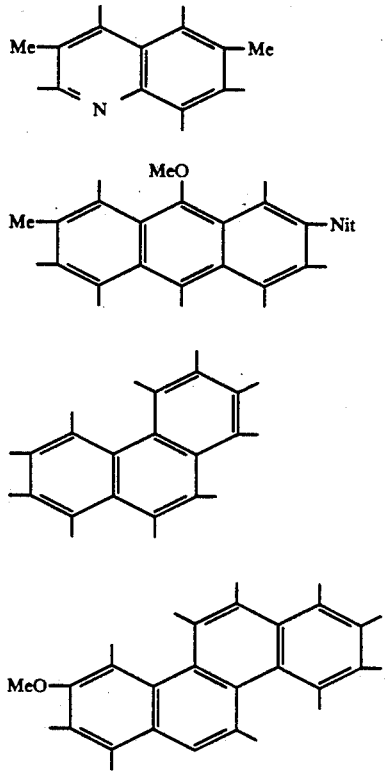

When the aromatic moiety Ar is a linked polynuclear aromatic moiety, it can be represented by the general formula $$ar\langle L—ar\rangle_w$$

wherein w is an integer of 1 to about 20, each ar is a single ring or a fused ring aromatic nucleus of 4 to about 12 carbon atoms and each L is independently selected from the group consisting of carbon-to-carbon single bonds between between ar nuclei, ether linkages (e.g. —O—), keto linkages (e.g., $$--\overset{O}{\overset{\|}{C}}—),$$

sulfide linkages (e.g., —S—), polysulfide linkages of 2 to 6 sulfur atoms (e.g., $—S—_{2\text{-}6}$), sulfinyl linkages (e.g., —S(O)—), sulfonyl linkages (e.g., $—S(O)_2—$), lower alkylene linkages (e.g.

$$—CH_2—,\ —CH_2—CH_2—,\ —CH—\underset{\underset{R^o}{|}}{CH}—)$$

di(lower alkyl)-methylene linkages (e.g., $—CR._2—$), lower alkylene ether linkages (e.g., $$—CH_2O—,\ —CH_2O—CH_2—,\ —CH_2—CH_2—O,$$

$$—CH_2CH_2OCH_2CH_2—,\ —CH_2\underset{\underset{R^o}{|}}{CH}OCH_2\underset{\underset{R^o}{|}}{CH}—,$$

-continued $$-CH_2\underset{R^o}{CH}O\underset{R^o}{CH}CH_2-, \text{ etc.),}$$

lower alkylene sulfide linkages (e.g., wherein one or more —O—'s in the lower alkylene ether linkages is replaced with a S atom), lower alkylene polysulfide linkages (e.g., wherein one or more —O— is replaced with a $-S-_{2-6}$ group), amino linkages (e.g., $$-\underset{H}{N}-,\ -\underset{R^o}{N}-,\ -CH_2\underset{|}{N}-,\ -CH_2\underset{|}{N}CH_2-,\ -\text{alk-}\underset{|}{N}-,$$

where alk is lower alkylene, etc.), polyamino linkages (e.g., $$-\underset{|}{N}(\underset{|}{alkN})_{1-10},$$

where the unsatisfied free N valences are taken up with H atoms or R. groups), linkages derived from oxo- or keto- carboxylic acids (e.g.)

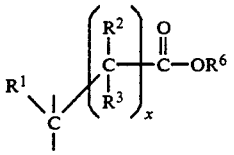

wherein each of $R^1$, $R^2$ and $R^3$ is independently hydrocarbyl, preferably alkyl or alkenyl, most preferably lower alkyl, or H, $R^6$ is H or an alkyl group and x is an integer ranging from 0 to about 8, and mixtures of such bridging linkages (each R. being a lower alkyl group).

Specific examples of linked moieties are:

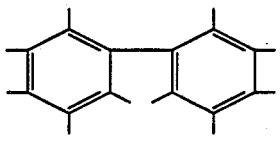

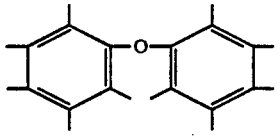

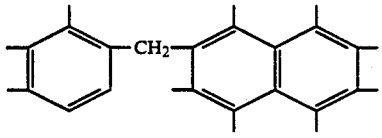

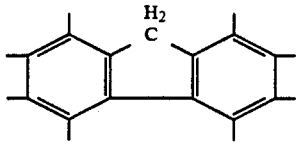

-continued

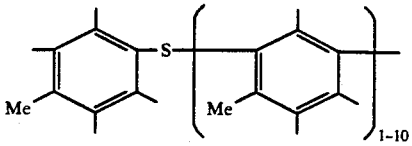

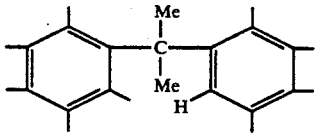

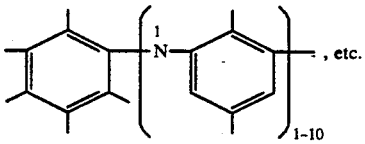

Usually all of these Ar groups have no substituents except for the R and Z groups (and any bridging groups).

For such reasons as cost, availability, performance, etc., Ar is normally a benzene nucleus, a lower alkylene bridged benzene nucleus, or a naphthalene nucleus

The Group R

The compounds of formula (I) employed in the compositions of the present invention preferably contain, directly bonded to at least one aromatic group Ar, at least one group R which, independently, is a hydrocarbyl group. More than one hydrocarbyl group can be present, but usually no more than 2 or 3 hydrocarbyl groups are present for each aromatic nucleus in the aromatic group Ar.

The number of R groups on each Ar group is indicated by the the subscript m. For the purposes of this invention, each m may be independently 0 or an integer ranging from 1 up to about 10 with the proviso that m does not exceed the unsatisfied valences of the corresponding Ar. Frequently, each m is independently an integer ranging from 1 to about 3 In an especially preferred embodiment each m equals 1.

Each R frequently is an aliphatic group containing up to about 750 carbon atoms, frequently from 4 to about 750 carbon atoms, preferably from 4 to about 400 carbon atoms and more preferably from 4 to about 100 carbons. R is preferably alkyl or alkenyl, preferably substantially saturated alkenyl. In one preferred embodiment, R contains at least about 6 carbon atoms, often from 8 to about 100 carbons. In another embodiment, each R contains an average of at least about 30 carbon atoms, often an average of from about 30 to about 100 carbons. In another embodiment, R contains from 12 to about 50 carbon atoms. In a further embodiment, R contains from about 8 to about 24 carbon atoms, preferably from 12 to about 24 carbon atoms and more preferably from 12 to about 18 carbon atoms. In one embodiment, at least one R is derived from an alkane or alkene having number average molecular weight ranging from about 300 to about 800. In another embodiment, R contains an average of at least about 50 carbon atoms When the group R is an alkyl or alkenyl group having from 2 to about 28 carbon atoms, it is typically derived from the corresponding olefin; for example, a butyl group is derived from butene, an octyl group is derived from octene, etc. When R is a hydrocarbyl group having at least about 30 carbon atoms, it is frequently an aliphatic group made from homo- or interpolymers (e.g., copolymers, terpolymers) of mono- and di-olefins having 2 to 10 carbon atoms, such as ethylene, propylene, butene-1, isobutene, butadiene, isoprene, 1-hexene, 1-octene, etc. Typically, these olefins are 1-mono olefins such as homopolymers of ethylene. These aliphatic hydrocarbyl groups may also be derived from halogenated (e.g., chlorinated or brominated) analogs of such homo- or interpolymers. R groups can, however, be derived from other sources, such as monomeric high molecular weight alkenes (e.g., 1-tetracontene) and chlorinated analogs and hydrochlorinated analogs thereof, aliphatic petroleum fractions, particularly paraffin waxes and cracked and chlorinated analogs and hydrochlorinated analogs thereof, white oils, synthetic alkenes such as those produced by the Ziegler-Natta process (e.g., poly(ethylene) greases) and other sources known to those skilled in the art. Any unsaturation in the R groups may be reduced or eliminated by hydrogenation according to procedures known in the art.

In one preferred embodiment, at least one R is derived from polybutene. In another preferred embodiment, R is derived from polypropylene. In a further preferred embodiment, R is a propylene tetramer.

As used herein, the term "hydrocarbyl group" denotes a group having a carbon atom directly attached to the remainder of the molecule and having predominantly hydrocarbon character within the context of this invention. Thus, the term "hydrocarbyl" includes hydrocarbon, as well as substantially hydrocarbon, groups, Substantially hydrocarbon describes groups, including hydrocarbon based groups, which contain non-hydrocarbon substituents, or non-carbon atoms in a ring or chain, which do not alter the predominantly hydrocarbon nature of the group.

Hydrocarbyl groups can contain up to three, preferably up to two, more preferably up to one, non-hydrocarbon substituent, or non-carbon heteroatom in a ring or chain, for every ten carbon atoms provided this non-hydrocarbon substituent or non-carbon heteroatom does not significantly alter the predominantly hydrocarbon character of the group. Those skilled in the art will be aware of such heteroatoms, such as oxygen, sulfur and nitrogen, or substituents, which include, for example, hydroxyl, halo (especially chloro and fluoro), alkoxyl, alkyl mercapto, alkyl sulfoxy, etc.

Examples of hydrocarbyl groups include, but are not necessarily limited to, the following:

(1) hydrocarbon groups, that is, aliphatic (e.g., alkyl or alkenyl), alicyclic (e.g., cycloalkyl, cycloalkenyl) groups, aromatic groups (e.g., phenyl, naphthyl), aromatic-, aliphatic- and alicyclic-substituted aromatic groups and the like as well as cyclic groups wherein the ring is completed through another portion of the molecule (that is, for example, any two indicated groups may together form an alicyclic radical);

(2) substituted hydrocarbon groups, that is, those groups containing non-hydrocarbon containing substituents which, in the context of this invention, do not significantly alter the predominantly hydrocarbon character; those skilled in the art will be aware of such groups (e.g., halo (especially chloro and fluoro), hydroxy, alkoxy, mercapto, alkylmercapto, nitro, nitroso, sulfoxy, etc.);

(3) hetero groups, that is, groups which will, while having a predominantly hydrocarbon character within the context of this invention, contain atoms other than carbon present in a ring or chain otherwise composed of carbon atoms. Suitable heteroatoms will be apparent to those of ordinary skill in the art and include, for example, sulfur, oxygen, nitrogen. Such groups as, e.g., pyridyl, furyl, thienyl, imidazolyl, etc. are representative of heteroatom containing cyclic groups.

Typically, no more than about 2, preferably no more than one, non-hydrocarbon substituent or non-carbon atom in a chain or ring will be present for every ten carbon atoms in the hydrocarbyl group. Usually, however, the hydrocarbyl groups are purely hydrocarbon and contain substantially no such non-hydrocarbon groups, substituents or heteroatoms.

Preferably, hydrocarbyl groups R are substantially saturated. By substantially saturated it is meant that the group contains no more than one carbon-to-carbon unsaturated bond, olefinic unsaturation, for every ten carbon-to-carbon bonds present. Usually, they contain no more than one carbon-to-carbon non-aromatic unsaturated bond for every 50 carbon-to-carbon bonds present In an especially preferred embodiment, the hydrocarbyl group R is substantially free of carbon to carbon unsaturation. It is to be understood that, within the content of this invention, aromatic unsaturation is not normally considered to be olefinic unsaturation. That is, aromatic groups are not considered as having carbon-to-carbon unsaturated bonds.

Preferably, hydrocarbyl groups R of the anion containing groups of formula (II) of this invention are substantially aliphatic in nature, that is, they contain no more than one non-aliphatic (cycloalkyl, cycloalkenyl or aromatic) group for every 10 carbon atoms in the R group. Usually, however, the R groups contain no more than one such non-aliphatic group for every 50 carbon atoms, and in many cases, they contain no such non-aliphatic groups; that is, the typical R group is purely aliphatic. Typically, these purely aliphatic R groups are alkyl or alkenyl groups.

Specific non-limiting examples of substantially saturated hydrocarbyl R groups are: methyl, tetra (propylene), nonyl, triisobutyl, oleyl, tetracontanyl, henpentacontanyl, a mixture of poly(ethylene/propylene) groups of about 35 to about 70 carbon atoms, a mixture of the oxidatively or mechanically degraded poly(ethylene/propylene) groups of about 35 to about 70 carbon atoms, a mixture of poly (propylene/1-hexene) groups of about 80 to about 150 carbon atoms, a mixture of poly(isobutene) groups having between 20 and 32 carbon atoms, and a mixture of poly(isobutene) groups having an average of 50 to 75 carbon atoms. A preferred source of hydrocarbyl groups R are polybutenes obtained by polymerization of a $C_4$ refinery stream having a butene content of 35 to 75 weight percent and isobutene content of 15 to 60 weight percent in the presence of a Lewis acid catalyst such as aluminum trichloride or boron trifluoride. These polybutenes contain predominantly (greater than 80% of total repeating units) isobutene repeating units of the configuration

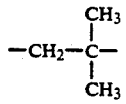

The attachment of a hydrocarbyl group R to the aromatic moiety Ar of the compounds of formula (I) of this invention can be accomplished by a number of techniques well known to those skilled in the art. One particularly suitable technique is the Friedel-Crafts reaction, wherein an olefin (e.g., a polymer containing an olefinic bond), or halogenated or hydrohalogenated analog thereof, is reacted with a phenol in the presence of a Lewis acid catalyst. Methods and conditions for carrying out such reactions are well known to those skilled in the art. See, for example, the discussion in the article entitled, "Alkylation of Phenols" in "Kirk-Othmer Encyclopedia of Chemical Technology", Third Edition, Vol. 2, pages 65-66, Interscience Publishers, a division of John Wiley and Company, N.Y., and U.S. Pat. Nos. 4,379,065; 4,663,063; and 4,708,809, all of which are expressly incorporated herein by reference for relevant disclosures regarding alkylation of aromatic compounds. Other equally appropriate and convenient techniques for attaching the hydrocarbon-based group R to the aromatic moiety Ar will occur readily to those skilled in the art.

The Groups Z

Each Z is independently OH, $(OR^4)_bOH$ or $O^-$ wherein each $R^4$ is independently a divalent hydrocarbyl group and b is a number ranging from 1 to about 30.

The subscript c indicates the number of Z groups that may be present as substituents on each Ar group. There will be at least one Z group substituent, and there may be more, depending on the value of the subscript m. For the purposes of this invention, c is a number ranging from 1 to about 3. In a preferred embodiment, c is 1.

As will be appreciated from the foregoing, the compounds of Formula I employed in this invention contain at least two Z groups and may contain one or more R groups as defined hereinabove. Each of the foregoing groups must be attached to a carbon atom which is a part of an aromatic nucleus in the Ar group. They need not, however, each be attached to the same aromatic nucleus if more than one aromatic nucleus is present in the Ar group.

As mentioned hereinabove, each Z group may be, independently, OH, $O^-$, or $(OR^4)_bOH$ as defined hereinabove. In a preferred embodiment, each Z is OH. In another embodiment, each Z may be $O^-$. In another preferred embodiment, at least one Z is OH and at least one Z is $O^-$. Alternatively, at least one Z may be a group of the Formula $(OR^4)_bOH$. As mentioned hereinabove, each $R^4$ is independently a divalent hydrocarbyl group. Preferably, $R^4$ is an aromatic or an aliphatic divalent hydrocarbyl group. Most preferably, $R^4$ is an alkylene group containing from 2 to about 30 carbon atoms, more preferably from 2 to about 8 carbon atoms and most preferably 2 or 3 carbon atoms.

The subscript b typically ranges from 1 to about 30, preferably from 1 to about 10, and most preferably 1 or 2 to about 5.

The Groups $R^1$, $R^2$ and $R^3$

Each of the groups $R^1$, $R^2$ and $R^3$ is independently H or a hydrocarbyl group. In one embodiment, each of $R^1$, $R^2$ and $R^3$ is, independently, H or a hydrocarbyl group having from 1 to about 100 carbon atoms, more often from 1 to about 24 carbon atoms. In a preferred embodiment, each of the aforementioned groups is independently hydrogen or alkyl or an alkenyl group. In one preferred embodiment each of $R^1$, $R^2$ and $R^3$ is, independently, H or lower alkyl. In an especially preferred embodiment, each of the aforementioned groups is H. For the purposes of this invention, the term "lower" when used to describe an alkyl or alkenyl group means from 1 to 7 carbon atoms.

The subscript x denotes the number of

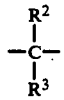

groups present in the anion containing group of Formula II. For the purposes of this invention, x normally ranges from 0 to about 8. In a preferred embodiment, x is 0, 1 or 2. Most preferably x equals 0.

The Group T

It will be apparent that when t=1 in any of Formula II, V or VI, that groups of Formulae V or VI will be present. Termination takes place when t=0. Thus, for example, when t=1 on Formula II, a group of Formula V or VI will be present. It follows then that in order for a group of Formula V or VI to be present in the anion containing group of Formula II, t in Formula II equals 1.

Likewise when t=1 in Formula II a group of Formula V or VI is present. When t in either Formula V or VI equals 0, no further T groups are present. However, when t in Formula V or VI equals 1, one or more additional T groups are present, terminating only when finally t=0.

In one preferred embodiment t in Formula II equals 0 and no groups of Formula V or VI are present In another preferred embodiment t in Formula II equals 1 and from 1 to about 3, preferably up to 2 additional groups T of Formula V or VI are present.

The Metal Ions M

The symbol M in Formula I represents one or more metal ions. These include alkali metal, alkaline earth metals, zinc, cadmium, lead, cobalt, nickel, iron, manganese, copper and others. Preferred are the alkali and alkaline earth metals. Especially preferred are sodium, potassium, calcium, and lithium. Most preferred are sodium and lithium.

The metal ions M may be derived from reactive metals or reactive metal compounds that will react with carboxylic acids or phenols to form carboxylates and phenates. The metal salts may be prepared from reactive metals such as alkali metals, alkaline earth metals, zinc, lead, cobalt, nickel, iron and the like. Examples of reactive metal compounds are sodium oxide, sodium hydroxide, sodium carbonate, sodium methylate, sodium phenoxide, corresponding potassium and lithium compounds, calcium oxide, calcium hydroxide, calcium carbonate, calcium methylate, calcium chloride, calcium phenoxide, and corresponding barium and magnesium compounds, zinc oxide, zinc hydroxide, zinc carbonate, cadmium chloride, lead oxide, lead hydroxide, lead carbonate, nickel oxide, nickel hydroxide, nickel nitrate, cobalt oxide, ferrous carbonate, ferrous oxide, cupric acetate, cupric nitrate, etc.

The above metal compounds are merely illustrative of those useful in this invention and the invention is not to be considered as limited to such. Suitable metals and metal-containing reactants are disclosed in many U.S. patents including U.S Pat. Nos. 3,306,908; 3,271,310; and U.S. Pat. No. Re. 26,433.

The Total Valence y

The skilled worker will appreciate that the compounds of the general formula $$A^{y-}M^{y+} \quad (I)$$

constitute a substantially neutral metal salt, which metal salt is a carboxylate and/or phenate, depending on the nature of A. Depending on the nature of the group Z in Formula (II), A may be a carboxylate, or a carboxylate-phenate, a carboxylate-mixed phenate/phenol, a carboxylate-alkoxylate, a carboxylate-phenatealkoxylate, a carboxylate-phenate/phenol-alkoxylate, etc. The group A may also represent mixtures of two or more of these. Accordingly, it is apparent that the value of y is dependent upon the number of anion-containing moieties making up A and on the valence of the metal ion M.

Preferably, salts of Formula I are neutral salts. However, it is to be understood that salts of formula I comprising up to about 50% unreacted carboxylic acid groups or lactone are also contemplated as being within the scope of this invention. Preferably, the salt of Formula(I) comprises no more than about 30% unreacted carboxylic acid groups or lactone, more preferably, no more than about 15% and even more preferably, no more than about 5% unreacted carboxylic acid or lactone.

It is also to be understood that the salts of Formula (I) may also be slightly basic, that is, they may contain a small excess of metal beyond that which is normally expected based on the stoichiometry of the components making up Formula (I). Preferably, no more than 25% excess metal, more preferably no more than 15% and even more preferably, no more than 5% excess metal is incorporated into the salt of Formula (I).

As was indicated hereinabove, especially preferred and normally, the salt of Formula (I) is substantially neutral, that is, the amount of metal is no more than about 1% above or below that normally expected based on the stoichiometry of the components of the salt of Formula (I).

The products of Formula (I) employed as additives in the two-cycle lubricating oil compositions and lubricant-fuel compositions of this invention may be readily prepared by reacting (a) a reactant of the formula $$R_m-\underset{\underset{(H)_s}{|}}{Ar}-Z_c \quad (III)$$

wherein R is an aliphatic hydrocarbyl group, m ranges from 0 to about 10, Ar is an aromatic group containing from 4 to about 30 carbon atoms having from 0 to 3 optional substituents selected as described hereinabove, or an analog of such an aromatic nucleus, wherein s is an integer of at least 1 and wherein the total of s+m does not exceed the available valences of Ar and Z is selected from the group consisting of OH or $(OR^4)_bOH$ wherein each $R^4$ is independently a divalent hydrocarbyl group and b is a number ranging from 1 to about 30 and c ranges from 1 to about 3, with (b) a carboxylic reactant of the formula $$R^1CO(CR^2R^3)_xCOOR^6 \quad (IV)$$

wherein $R^1$, $R^2$ and $R^3$ are independently H or a hydrocarbyl group, $R^6$ is H or an alkyl group, and x is an integer ranging from 0 to about 8 and then reacting the intermediate so formed with a metal-containing reactant to form a salt.

When $R^1$ is H, the aldehyde moiety of reactant (IV) may be hydrated For example, glyoxylic acid is readily available commercially as the hydrate having the formula $$(HO)_2CH-COOH.$$

Water of hydration as well as any water generated by the condensation reaction is preferably removed during the course of the reaction.

Ranges of values and descriptions of the groups and subscripts appearing in the above Formulae (III) and (IV) are the same as recited hereinabove for Formulae (I) and (II). When $R^6$ is an alkyl group it is preferably a lower alkyl group, most preferably, ethyl or methyl.

The reaction is normally conducted in the presence of a strong acid catalyst. Particularly useful catalysts are illustrated by methanesulfonic acid and para-toluenesulfonic acid. The reaction is usually conducted with the removal of water.

Reactants (a) and (b) are preferably present in a molar ration of about 2:1; however, useful products may be obtained by employing an excess amount of either reactant. Thus, molar ratios of (a):(b) of 1:1, 2:1, 1:2, 3:1, etc. are contemplated and useful products may be obtained thereby. Illustrative examples of reactants (a) of Formula (III) include hydroxy aromatic compounds such as phenols, both substituted and unsubstituted within the constraints imposed on Ar hereinabove, alkoxylated phenols such as those prepared by reacting a phenolic compound with an epoxide, and a variety of aromatic hydroxy compounds. In all the above cases, the aromatic groups bearing the phenolic —OH or $(OR^4)_bOH$ groups may be single ring, fused ring or linked aromatic groups as described in greater detail hereinabove.

Specific illustrative examples of compound (III) employed in the preparation of compounds of Formula (I) containing the anion containing groups A of Formula (II) include, phenol, naphthol, 2,2'-dihydroxybiphenyl, 4,4-dihydroxybiphenyl, 3-hydroxyanthracene, 1,2,10-anthracenetriol, resorcinol, 2-t-butyl phenol, 4-t-butyl phenol, 2,6-di-t-butyl phenol, octyl phenol, cresols, propylene tetramer-substituted phenol, propylene oligomer (MW 300–800)-substituted phenol, polybutene ($M_n$ about 1000) substituted phenol substituted naphthols corresponding to the above exemplified phenols, methylene-bis-phenol, bis-(4-hydroxyphenyl)-2,2-propane, and hydrocarbon substituted bis-phenols wherein the hydrocarbon substituents are, for example, methyl, butyl, heptyl, oleyl, polybutenyl, etc., sulfide-and polysulfide-linked analogues of any of the above, alkoxylated derivatives of any of the above hydroxy aromatic compounds, etc. Preferred compounds of Formula (III) are those that will lead to the compounds of Formula (I) having preferred anion containing groups of Formula (II).

The method of preparation of numerous alkyl phenols is well-known. Illustrative examples of alkyl phenols and related aromatic compounds and methods for preparing same are give in U.S. Pat. No. 4,740,321 to Davis et al. This patent is hereby incorporated herein by reference.

Non-limiting examples of the carboxylic reactant (b) of Formula IV include glyoxylic acid and other omega-oxoalkanoic acids, keto alkanoic acids such as pyruvic acid, levulinic acid, ketovaleric acids, ketobutyric acids and numerous others. The skilled worker will readily recognize the appropriate compound of Formula (IV) to employ as a reactant to generate a given anion-containing group A. Preferred compounds of Formula (IV) are those that will lead to compounds of Formula (I) having preferred anion containing groups of Formula (II).

U.S. Pat. No. 2,933,520 (Bader) and U.S. Pat. No. 3,954,808 (Elliott et al) describe procedures for preparing the intermediate via reaction of phenol and acid. These patents are expressly incorporated herein for relevant disclosures contained therein.

The intermediate product obtained from the reaction of the foregoing hydroxy aromatic compounds and carboxylic acids is then reacted with a metal containing reactant to form a salt. Suitable metal containing reactants have been enumerated hereinabove.

The above examples are intended to be illustrative of suitable reactants and are not intended, and should not be viewed as, an exhaustive listing thereof.

It will be appreciated that the reaction of reactants (a) and (b) will lead to a compound containing a group Z which may be —OH or $(OR^4)_bOH$, as described hereinabove except that when the product is a lactone, Z may be absent. Furthermore, a phenolic group containing product may be reacted with, for example, an epoxide, to generate —$(OR^4)OH$ groups, either on the intermediate arising from reaction of (a) and (b) or of a salt thereof.

The intermediate arising from the reaction of (a) and (b) may be a carboxylic acid or a lactone, depending upon the nature of (a). In particular, when (a) is a highly hindered hydroxy aromatic compound, the product from (a) and (b) is usually a carboxylic acid. When the hydroxy aromatic reactant (a) is less hindered, a lactone is generated.

Often, the intermediate arising from the reaction of (a) and (b) is a mixture comprising both lactone and carboxylic acid.

When the intermediate from (a) and (b) is further reacted with the metal-containing reactant, generally a carboxylic acid salt is formed first. If an excess of metal reactant is used, an amount beyond that needed for formation of a carboxylic acid salt, further reaction takes place at aromatic —OH groups.

From time to time it has been noted that before all lactone is converted to carboxylic acid salt, the beginning of conversion of phenolic —OH groups to O⁻ groups, i.e., phenate salts, is observed. This appears to occur most often when the metal reactant is a calcium reactant.

The carboxylate salt forms by reaction of the metal containing reactant with the lactone, opening the lactone ring, forming a carboxylate salt, or from direct reaction with a carboxylic acid group. It is generally preferred to utilize sufficient metal-containing reactant to substantially neutralize all of the carboxylic acid; however, conversion of at least 50%, more preferably 75% of lactone or carboxylic acid to carboxylic acid salt is desirable. Preferably, at least 90%, more preferably 99–100% conversion of lactone or carboxylic acid to carboxylic acid salt is effected.

The following specific illustrative Examples describe the preparation of the compounds of Formula (I) useful in the compositions of this invention. In the following examples, as well as in the claims and in the specification of this application, parts are parts by weight, the temperature is degrees Celsius and the pressure is atmospheric, unless otherwise indicated.

As will be readily apparent to those skilled in the art, variations of each of the illustrated reactants and combinations of reactants and conditions may be used.

EXAMPLE 1

A mixture is prepared by combining 3317 parts of a polybutene-substituted phenol prepared by boron trifluoride-phenol catalyzed alkylation of phenol with a polybutene having a number average molecular weight of approximately 1,000 (vapor phase osmometry), 218 parts 50% aqueous glyoxylic acid (Aldrich Chemical) and 1.67 parts 70% aqueous methanesulfonic acid in a reactor equipped with a stirrer, thermo-well, subsurface gas inlet gas inlet and a Dean-Stark trap with condenser for water removal. The mixture is heated under a nitrogen flow to a temperature of 160° C. over one hour. The reaction is held at 160° C. for four hours with removal of water; a total of 146 parts aqueous distillate is collected. Mineral oil diluent, 2284 parts, is added with stirring followed by cooling of the reaction mixture to room temperature At room temperature, 117.6 parts 50% aqueous sodium hydroxide and 500 parts water are added with stirring followed by exothermic reaction to about 40° C. over 10 minutes. The Dean-Stark trap is removed and the condenser is arranged to allow for reflux. The mixture is heated over one hour to a temperature of 95° C. and is held at this temperature for three hours. The reaction mixture is then cooled to about 60° C. and stripping is started by applying a vacuum to reduce the pressure to about 100 millimeters mercury. The pressure is slowly decreased and the temperature is increased over a period of approximately eight hours until the temperature is 95° C. and the pressure is 20 millimeters mercury. The reaction is then held at this temperature and pressure for three hours to complete stripping. The residue is filtered through a diatomaceous earth filter aid at a temperature of about 95° C. The resulting product, containing approximately 40% mineral oil diluent has a sodium content of 0.58%, ASTM color (D1500) of 7.0 (neat), and a total base number of 13.2. The infra-red spectrum of the product is substantially free of absorption at 1790 $cm^{-1}$ indicating absence of lactone carbonyl.

EXAMPLE 2

A reactor is charged with 3537 parts of a propylene tetramer-substituted phenol prepared by alkylation of phenol with a propylene tetramer in the presence of a sulfonated polystyrene catalyst (marketed as Amberlyst-15 by Rohm & Haas Company), 999 parts of 50% aqueous glyoxylic acid (Hoechst Celanese) and 3.8 parts 70% aqueous methane sulfonic acid. The reaction is heated to 160° C. over three hours under a nitrogen flow. The reaction is held at 160° C. for four hours while collecting 680 parts water in a Dean-Stark trap.

A mineral oil diluent, 2710 parts, is added in one portion with stirring and the reaction is cooled to room temperature. At room temperature, 540 parts 50% aqueous sodium hydroxide and 1089 parts water are added quickly with stirring followed by an exothermic reaction to about 54° C. over ten minutes. The Dean-Stark trap is removed and the condenser is arranged to allow for reflux. The reaction mixture is heated to 95°–100° C.

and held at this temperature range for three hours. The mixture is then cooled to 60° C. and a vacuum is applied until the pressure reaches 100 millimeters mercury. Vacuum stripping of water is begun while the temperature is slowly increased to 95°-100° C. over seven hours while reducing pressure to 20 millimeters mercury. Stripping is continued at 95°-100° C. at 20 millimeters mercury pressure for three hours. The residue is filtered through a diatomaceous earth filter aid at 90°-100° C. A product containing approximately 40% diluent oil is obtained containing, by analysis, 2.18% sodium and which has an ASTM color (D-1500) of 6.5. The infra-red spectrum shows no significant absorption at 1790 $cm^{-1}$ indicating the product contains no lactone carbonyl.

EXAMPLE 3

A mixture of 681 parts of a polyisobutene substituted phenol-glyoxylic acid reaction product prepared according to the procedure of Example 1, 11 parts calcium hydroxide, 461 parts of mineral oil and 150 parts of water are charged to a reactor and heated under a nitrogen blanket at 100°-105° C. for four hours. The reaction mixture is stripped at 115°-120° C. at five millimeters mercury pressure over four hours. The residue is filtered at 115°-120° C. employing a diatomaceous earth filter aid. The filtered product containing approximately 40% diluent oil contains, by analysis, 0.42% calcium and has a total base number of 15.1. The infra-red spectrum of the product shows a weak absorption at 1778 $cm^{-1}$ indicating a trace of lactone in the product.

EXAMPLE 4

A reactor is charged with 655 parts of a propylene tetramer-substituted phenol prepared according to the procedure given in Example 2, 185 parts 50% aqueous glyoxylic acid (Aldrich) and 0.79 parts 70% aqueous methanesulfonic acid. The flask is equipped with a subsurface nitrogen inlet, a stirrer, thermo-well and Dean-Stark trap for the collection of water. The materials are heated to 120° C. over three hours. 119 parts water is collected (theory = 137.5 parts). Mineral oil diluent (490 parts) is added in one increment followed by cooling to 60° C. At 60° C., 52.5 parts lithium hydroxide monohydrate is added. No exothermic reaction is noted. The reaction mixture is heated to 95° C. for one hour. At this point the infra-red shows substantially no lactone absorption. Heating at 95° C. is continued for an additional two hours, followed by vacuum stripping to 95° C. at 25 millimeters mercury for three hours. The residue is filtered through diatomaceous earth filter aid. The dark orange liquid contains 5.02% sulfate ash which indicates 0.63% lithium content. The product has a total base number of 59.

EXAMPLE 5

A reactor is charged with 2500 parts of a propylene tetramer-substituted phenol prepared according to the procedure given in Example 2, 706 parts 50% aqueous glyoxylic acid (Aldrich) and 4.75 parts paratoluene sulfonic acid monohydrate (Eastman) and 650 parts toluene. The materials are heated under nitrogen at reflux (maximum temperature 140° C.) for 10 hours; 490 parts water is collected using a Dean-Stark trap. The reaction product is stripped to 130° C. at 20 millimeters mercury pressure over three hours. Mineral oil diluent (1261 parts) is added and the product is filtered through diatomaceous earth filter aid at 100° C. The infra-red spectrum shows an absorbance at 1795 $cm^{-1}$ indicating the presence of lactone Another reactor is charged with 500 parts of this lactone-containing product, 48.4 parts 50% aqueous sodium hydroxide, 100 parts water and 83 parts mineral oil diluent The materials are reacted under nitrogen at 95°-100° C. for ten hours. The reaction mixture is vacuum stripped to 120° C. at 20 millimeters mercury pressure over three hours. The residue is filtered through a diatomaceous earth filter aid at 100°-120° C. The filtered product shows 2.36% sodium, by analysis. The infra-red spectrum shows no lactone carbonyl absorption at 1795 $cm^{-1}$.

EXAMPLE 6

A reactor is charged with 2849 parts of a polypropylene substitued phenol prepared by alkylation of phenol with a polypropylene having a molecular weight of about 400 in the presence of a boron trifluoride-ether catalyst, 415 parts of 50% aqueous glyoxylic acid (Aldrich) and 4 parts of paratoluenesulfonic acid monohydrate (Eastman). The reactants are heated under nitrogen to 155°-160° C. over three hours. Heating is continued at 155°-160° C. for four hours. A total of 278 parts water is collected employing a Dean-Stark trap.

Another reactor is charged with 600 parts of the above-described product, 91 parts of 50% aqueous sodium hydroxide, about 347 parts toluene and 424 parts mineral oil. The materials are heated at reflux (maximum temperature −125° C.) for six hours. 54.5 parts water is collected using a Dean-Stark trap. The reaction mixture is stripped to 120° C. at 30 millimeters mercury pressure over three hours. The residue is filtered employing a diatomaceous earth filter aid at 110°-120° C. The residue contains, by analysis, 2% sodium. The infra-red spectrum shows no lactone carbonyl absorption at 1795 $cm^{-1}$.

EXAMPLE 7

A reactor is charged with 700 parts of the polypropylene substituted phenol-glyoxylic acid reaction product described in Example 6, 24.5 parts calcium hydroxide, about 100 parts water and 483 parts mineral oil. The materials are heated under nitrogen to 95°-100° C. and held at that temperature for eight hours. The infra-red spectrum at this point indicates lactone has been consumed The materials are vacuum stripped to 100°-105° C. at 20 millimeters mercury pressure over two hours. The residue is filtered at 100°-105° C. employing a diatomaceous earth filter aid. The filtrate contains, by analysis, 0.934% calcium. The infra-red spectrum shows that a small amount of lactone remains.

A reactor is charged with 528 parts of a propylene-tetramer substituted phenol-glyoxylic acid reaction product prepared in the same manner described in Example 4, 18.5 parts sodium hydroxide, about 433 parts toluene and 40 parts water. The materials are heated under nitrogen at 85° C. (reflux) for four hours. Barium chloride dihydrate (Eastman) (56 parts) is added and the materials are heated at reflux for four hours followed by removal of water employing a Dean-Stark trap over three hours. The materials are cooled and solids are removed by filtration. The filtrate is stripped to 150° C. at 15 millimeters mercury pressure. The residue contains, by analysis, 2.82% barium and 1.01% sodium. The infra-red spectrum shows a weak lactone absorption.

EXAMPLE 9

A mixture is prepared by combining 680 parts of a polybutene-substituted phenol such as described in Example 1, 44.7 parts 50% aqueous glyoxylic acid (Aldrich) and 0.34 parts methanesulfonic acid in a reactor equipped with a subsurface gas inlet, thermowell, stirrer, and Dean-Stark trap with condenser. The materials are heated to 120° C. and held at that temperature for three hours; 24 parts water is collected. Mineral oil, 466 parts, is added followed by cooling of the materials to 73° C. A solution of 12.68 parts lithium hydroxide monohydrate is dissolved in 50 parts water. This solution is added to the reactor at 73° C. No exothermic reaction is noted. The Dean-Stark trap is removed and the condenser is replaced. The materials are heated to 95° C. and are held at that temperature for two hours. The materials are stripped at 95° C. at 20 millimeters mercury pressure for two hours. The residue is filtered through a diatomaceous earth filter aid at 95° C. The filtrate contains, by analysis, 0.51% lithium and 1.20% sulfate ash and has a total base number of 13.55. The ASTM color (D-1500 procedure) is 5.5.

EXAMPLE 10

A reactor is charged with 420 parts of a propylenetetramer substituted phenol-glyoxylic acid reaction product prepared according to the procedure given in Example 4, 31 parts potassium hydroxide and about 260 parts toluene. The materials are heated under nitrogen to 120° C. and held at 120°-130° C. for four hours. Following reaction, the infra-red spectrum shows no lactone remains Naphthenic oil diluent (660 parts) is added followed by stripping to 140° C. at 2 millimeters mercury pressure for three hours. The residue is filtered through a diatomaceous earth filtrate at 130°-140° C. The filtrate contains, by analysis, 1.47% potassium and has a total base number of 21.6.

EXAMPLE 11

The reactor is charged with 350 parts of the potassium salt described in Example 10, 55 parts zinc chloride, about 350 parts xylene and 80 parts water. The materials are heated to reflux (90°-95° C.) under nitrogen Heating is continued at 90°-95° C. for 10 hours. Water is removed as an azeotrope employing a Dean-Stark trap. Following reaction, solids are removed by filtration. The filtrate is stripped under vacuum. The residue contains, by analysis, 0.27% zinc and 0% potassium. The infra-red spectrum shows the presence of an undetermined amount of lactone.

EXAMPLE 12

A reactor is charged with 130 parts of a propylene tetramer substituted phenol-glyoxylic acid reaction product prepared as described in Example 2, 8.2 parts of potassium hydroxide, 10 parts water and 130 parts xylene. The materials are heated under nitrogen at 90 for three hours. Barium chloride dihydrate (16 parts) is added and the reactants are heated at reflux under nitrogen for five hours. Following the heating period water is removed using a Dean-Stark trap. The mixture is cooled and filtered The filtrate is stripped under vacuum on a rotary evaporator. The residue contains, by analysis, 2.91% barium and 2.04% potassium. The neutraliztion number employing bromphenol blue indicator is 28.8.

EXAMPLE 13

A reactor is charged with 700 parts of the polypropylene substituted phenol-glyoxylic acid reaction product described in Example 6, 53 parts 50% aqueous sodium hydroxide, 100 parts water and 484 parts mineral oil. The materials are heated under nitrogen at 95°-100° C. for five hours. The reaction mixture is stripped to 120° C. at 20 millimeters mercury pressure for three hours. The residue is filtered employing a diatomaceous earth filter aid.

EXAMPLE 14

A reactor is charged with 500 parts of a propylene tetramer substituted phenol-glyoxylic acid reaction product prepared in a fashion similar to that as described in Example 4, but containing about 32% by weight mineral oil diluent, 22.4 parts calcium hydroxide, 100 parts water and 82 parts mineral oil. The reaction mixture is heated under nitrogen at reflux (95°-100° C.) for twelve hours. At this point the infra-red shows substantially no lactone carbonyl absorption. The reaction mixture is stripped to 100° C. at 20 millimeters mercury pressure for three hours. The residue is filtered at 95°-100° C. employing a diatomaceous earth filter aid.

EXAMPLES 15-21

Reaction products are prepared substantially according to the procedure of Example 1, replacing the polybutene substituted phenol with an equivalent amount, based on the molecular weight, of the alkylated hydroxy aromatic compounds listed in the following Table I

TABLE I

| Example | Name | Mol. Wt.[1] |
|---|---|---|
| 15 | 2,2'-dipoly(isobutene)yl-4,4'-dihydroxybiphenyl | 2500 |
| 16 | 8-hydroxy-poly(propene)yl-1-azanaphthalene | 900 |
| 17 | 4-poly(isobutene)yl-1-naphthol | 1700 |
| 18 | 2-poly(propene/butene-1)yl-4,4'-isopropylidene-bisphenol[2] | 3200 |
| 19 | 4-tetra(propene)yl-2-hydroxy-anthracene | — |
| 20 | 4-octadecyl-1,3-dihydroxybenzene | — |
| 21 | 4-poly(isobutene)-3-hydroxy-pyridine | 1300 |

[1]Number average molecular weight by vapor phase osmometry
[2]The mo'ar ratio of propene to butene-1 in the substituent is 2:3

EXAMPLE 22

The procedure of Example 3 is repeated except the polybutene has an average molecular weight of about 1400.

EXAMPLE 23

The procedure of Example 9 is repeated employing a substituted phenol (having an —OH content of 1.88%, prepared by reacting polyisobutenyl chloride having a viscosity at 99° C. of 1306 SUS (Sayboldt Universal Seconds) and containing 4.7% chlorine with 1700 parts phenol).

EXAMPLE 24

The procedure of Example 14 is repeated replacing the propylene tetramer substituted phenol with an equivalent number of moles of a sulfurized alkylated phenol prepared by reacting 1000 parts of a propylene tetramer substituted phenol as described in Example 2 with 175 parts of sulfur dichloride and diluted with 400 parts mineral oil.

EXAMPLE 25

The procedure of Example 24 is repeated replacing the sulfurized phenol with a similar sulfurized phenol prepared by reacting 1000 parts of propylene tetramer substituted phenol with 319 parts of sulfur dichloride.

EXAMPLE 26

The procedure of Example 2 is repeated replacing glyoxylic acid with an equivalent amount, based on —COOH, of pyruvic acid.

EXAMPLE 27

The procedure of Example 6 is repeated replacing glyoxylic acid with an equivalent amount based on

EXAMPLES 28-30

The procedure of Example 3 is repeated employing the keto alkanoic acids given in Table II.

TABLE II

| Example | Acid |
|---|---|
| 28 | Pyruvic |
| 29 | 3-Ketobutyric |
| 30 | Keto valeric |

EXAMPLE 31

The procedure of Example 4 is repeated replacing glyoxylic acid with an equivalent amount, based on —COOH, of omega-oxo-valeric acid.

EXAMPLES 32-35

The procedures of each of Examples 1-4 is repeated replacing the alkylated phenol with a propylene tetramer-substituted catechol.

EXAMPLE 36

A reactor equipped with a subsurface gas inlet, stirrer, thermowell and Dean-Stark trap with condenser is charged with 676 parts of polybutene substituted phenol prepared as described in Example 1, 44 parts 50% aqueous glyoxylic acid, and 0.34 parts methanesulfonic acid. The materials are heated to 120° C. and held there for 3.5 hours while collecting 27 parts $H_2O$ (34 parts theory). Mineral oil diluent (467 parts) is added, the materials are cooled to 72° C. and a solution of 19.8 parts 85% KOH in 50 parts $H_2O$ is added. The Dean-Stark trap is removed, the condenser is replaced. A slight exotherm (about 1° C.) is observed. The materials are heated to 95° C. and held there for 2 hours. The materials are stripped to 95° C. at 20 mm Hg pressure and filtered employing a diatomaceous earth filter aid. The filtrate contains, by analysis, 0.85% K and 1.20% $SO_4$ ash. The total base number is 12.0. ASTM Color (D-1500)=6.0 neat, 8.0 dilute.

EXAMPLE 37

A reactor is charged with 318 parts of a polybutene-substituted phenol as described in Example 1, 0.16 parts 70% aqueous methanesulfonic acid and 31.5 parts of 50% aqueous glyoxylic acid (Aldrich). The materials are heated at 125°-130° C. for 6 hours while collecting 21.5 parts water in a Dean-Stark trap. Mineral oil diluent (223.1 parts) is added and the materials are cooled to room temperature. To this oil solution is added 17 parts 50% aqueous NaOH. An exothermic reaction is observed. The materials are heated for 3 hours at 100°-105° C., then vacuum stripped at 110°-120° C., 20mm Hg pressure, for 4 hours. The residue is filtered employing a diatomaceous earth filter aid.

EXAMPLE 38

A reactor is charged with 997 parts of the polybutene-substituted phenol as described in Example 1, 75.4 parts of 50% aqueous glyoxylic acid and 0.5 parts of methanesulfonic acid. The materials are heated at 120° C. for 4.5 hours while collecting 40 parts water in a Dean-Stark trap. The materials are then vacuum stripped to 120° C. at 20 mm Hg, removing an additional 5 parts aqueous distillate.

To another reactor is charged 450 parts of the above-described product, 15.7 parts 50% aqueous NaOH and 305 parts mineral oil diluent. The materials are heated with nitrogen purging at 95°-100° C. for 3 hours followed by vacuum stripping to 100° C. at 20 mm Hg and filtering through a diatomaceous earth filter aid. The filtrate contains, by analysis, 0.444% Na. The infrared spectrum shows a detectable absorption at 1788 $cm^{-1}$. The total base number is 11.5.

EXAMPLE 39

Following substantially the procedure of Example 38, 431 parts of the phenol-glyoxylic acid product described in that example and 17.3 parts 50% aqueous NaOH in 293 parts mineral oil diluent are reacted to form a product containg, by analysis, 0.64% sodium. The infrared spectrum shows no detectable absorption at 1788 $cm^{-1}$. The total base number is 14.6.

EXAMPLE 40

To a 5-liter flask are added 2182 parts of the alkyl phenol described in Example 1, 143.4 parts 50% aqueous glyoxylic acid and 1.1 parts 70% methane sulfonic acid The temperature is maintained at 155°-160° C. for 2 hours; 92 parts aqueous distillate is collected (theory 107 parts) in a Dean-Stark trap. Diluent oil (1533 parts) is added and the materials are cooled to 27° C. Sodium hydroxide (50% aqueous, 155 parts) is added and the materials are heated to 110° C. and held at 110°-120° C. for 2 hours. The materials are cooled to 50° C. then vacuum stripped over 4 hours to 110° C. at 20 mm Hg pressure. The residue is filtered employing a diatomaceous earth filter aid. The product contains, by analysis, 1.16% Na and has a total base number of 27.2.

In addition to the metal salts of Formula I the use of other additives is contemplated.

It is sometimes useful to incorporate, on an optional, as-needed basis, other known additives which include, but are not limited to, dispersants and detergents of the ash-producing or ashless type, antioxidants, anti-wear agents, extreme pressure agents, emulsifiers, demulsifiers, foam inhibitors, friction modifiers, anti-rust agents, corrosion inhibitors, viscosity improvers, pour point depressants, dyes, lubricity agents, and solvents to improve handleability which may include alkyl and/or aryl hydrocarbons. These optional additives may be present in various amounts depending on the intended application for the final product or may be excluded therefrom.

The ash-containing detergents are the well-known neutral or basic Newtonian or non-Newtonian, basic salts of alkali, alkaline earth and transition metals with one or more hydrocarbyl sulfonic acid, carboxylic acid, phosphoric acid, mono- and/or dithio phosphoric acid, phenol or sulfur coupled phenol, and phosphinic and thiophosphinic acid. Commonly used metals are sodium, potassium, calcium, magnesium, lithium, copper and the like. Sodium and calcium are most commonly used.

Neutral salts contain substantially equivalent amounts of metal and acid. As used herein, the expression basic salts refers to those compositions containing an excess amount of metal over that normally required to neutralize the acid substrate. Such basic compounds are frequently referred to as overbased, superbased, etc.

Dispersants include, but are not limited to, hydrocarbon substituted succinimides, succinamides, carboxylic esters, Mannich dispersants and mixtures thereof as well as materials functioning both as dispersants and viscosity improvers. The dispersants include nitrogen-containing carboxylic dispersants, ester dispersants, Mannich dispersants or mixtures thereof Nitrogen-containing carboxylic dispersants are prepared by reacting a hydrocarbyl carboxylic acylating agent (usually a hydrocarbyl substituted succinic anhydride) with an amine (usually a polyamine). Ester dispersants are prepared by reacting a polyhydroxy compound with a hydrocarbyl carboxylic acylating agent. The ester dispersant may be further treated with an amine. Mannich dispersants are prepared by reacting a hydroxy aromatic compound with an amine and aldehyde. The dispersants listed above may be post-treated with reagents such as urea, thiourea, carbon disulfide, aldehydes, ketones, carboxylic acids, hydrocarbon substituted succinic anhydride, nitriles, epoxides, boron compounds, phosphorus compounds and the like. These dispersants are generally referred to as ashless dispersants even though they may contain elements such as boron or phosphorus which, on decomposition, will leave a non-metallic residue.

Extreme pressure agents and corrosion- and oxidation-inhibiting agents include chlorinated compounds, sulfurized compounds, phosphorus containing compounds including, but not limited to, phosphosulfurized hydrocarbons and phosphorus esters, metal containing compounds and boron containing compounds.

Chlorinated compounds are exemplified by chlorinated aliphatic hydrocarbons such as chlorinated wax.

Examples of sulfurized compounds are organic sulfides and polysulfides such as benzyl disulfide, bis(-chlorobenzyl)disulfide, dibutyl tetrasulfide, sulfurized methyl ester of oleic acid, sulfurized alkylphenol, sulfurized dipentene, and sulfurized terpene.

Phosphosulfurized hydrocarbons include the reaction product of a phosphorus sulfide with turpentine or methyl oleate.

Phosphorus esters include dihydrocarbon and trihydrocarbon phosphites, phosphates and metal and amine salts thereof.

Phosphites may be represented by the following formulae:

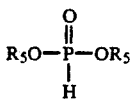

or

-continued $(R_5O)_3P$ wherein each $R_5$ is independently hydrogen or a hydrocarbon based group, provided at least one $R_5$ is a hydrocarbon based group.

Phosphate esters include mono-, di- and trihydrocarbon-based phosphates of the general formula $(R_5O)_3PO$.

Examples include mono-, di- and trialkyl; mono-, di and triaryl and mixed alkyl and aryl phosphates.

Metal containing compounds include metal thiocarbamates, such as zinc dioctyldithiocarbamate, and barium heptylphenyl dithiocarbamate and molybdenum compounds.

Boron containing compounds include borate esters and boron-nitrogen containing compounds prepared, for example, by the reaction of boric acid with a primary or secondary alkyl amine.

Viscosity improvers include, but are not limited to, polyisobutenes, polymethacrylate acid esters, polyacrylate acid esters, diene polymers, polyalkyl styrenes, alkenyl aryl conjugated diene copolymers, polyolefins and multifunctional viscosity improvers.

Pour point depressants are a particularly useful type of additive often included in the lubricating oils described herein. See for example, page 8 of "Lubricant Additives" by C. V. Smalheer and R. Kennedy Smith (Lesius-Hiles Company Publishers, Cleveland, Ohio, 1967).

Lubricity agents include synthetic polymers (e.g., polyisobutene having a number average molecular weight in the range of about 750 to about 15,000, as measured by vapor phase osmometry or gel permeation chromatography), polyolether (e.g., poly (oxyethylene-oxypropylene ethers) and ester oils. Natural oil fractions such as bright stocks (the relatively viscous products formed during conventional lubricating oil manufacture from petroleum) can also be used for this purpose. They are usually present, when used in two-cycle oils in amounts of about 3% to about 20% by weight of the total composition.

Diluents include such materials as petroleum naphthas boiling in the range of 30° to about 90° C. (e.g., Stoddard Solvent). When used, they are typically present in amounts ranging from about 5% to about 25% by weight.

Anti-foam agents used to reduce or prevent the formation of stable foam include silicones or organic polymers. Examples of these and additional anti-foam compositions are described in "Foam Control Agents", by Henry T. Kerner (Noyes Data Corporation, 1976), pages 125-162.

These and other additives are described in greater detail in U.S. Pat. No. 4,582,618 (column 14, line 52 through column 17, line 16, inclusive), herein incorporated by reference for its disclosure of other additives that may be used in the compositions of the present invention.

The components may be blended together in any suitable manner and then admixed, for example with a diluent to form a concentrate as discussed below, or with a lubricating oil, as discussed below. Alternatively, components can be admixed separately with such diluent or lubricating oil. The blending technique for mixing the components is not critical and can be effected using any standard technique, depending upon the specific nature of the materials employed In general, blending can be accomplished at room temperature; however, blending can be facilitated by heating the components.

As previously indicated, the compositions of the present invention are useful as additives for lubricants for 2-cycle engines. They can be employed in a variety of lubricant basestocks comprising diverse oils of lubricating viscosity, including natural and synthetic lubricating oils and mixtures thereof.

Natural oils include animal oils, vegetable oils, mineral lubricating oils, solvent or acid treated mineral oils, and oils derived from coal or shale. Synthetic lubricating oils include hydrocarbon oils, halo-substituted hydrocarbon oils, alkylene oxide polymers, esters of carboxylic acids and polyols, esters of polycarboxylic acids and alcohols, esters of phosphorus-containing acids, polymeric tetrahydrofurans, silicon-based oils and mixtures thereof.

Specific examples of oils of lubricating viscosity are described in U.S. Pat. No. 4,326,972 and European Patent Publication 107,282, both herein incorporated by reference for their disclosures relating to lubricating oils. A basic, brief description of lubricant base oils appears in an article by D. V. Brock, "Lubricant Base Oils", *Lubrication Engineering,* volume 43, pages 184–185, March, 1987. This article is herein incorporated by reference for its disclosures relating to lubricating oils. A description of oils of lubricating viscosity occurs in U.S. Pat. No. 4,582,618 (column 2, line 37 through column 3, line 63, inclusive), herein incorporated by reference for its disclosure to oils of lubricating viscosity.

The additives and components of this invention can be added directly to the lubricant. Preferably, however, they are diluted with a substantially inert, normally liquid organic diluent such as mineral oil, naphtha, toluene or xylene, to form an additive concentrate. These concentrates usually contain from about 10% to about 90% by weight of the components used in the composition of this invention and may contain, in addition, one or more other additives known in the art as described hereinabove. The remainder of the concentrate is the substantially inert normally liquid diluent.

The following Examples illustrate additive concentrates useful for preparing two-cycle lubricating oil compositions. All percentages are by weight. Totals may not add up to 100% because of rounding.

EXAMPLE I

An additive concentrate for two-cycle engine lubricants contains 2.55% of basic calcium sulfonate, 0.91% overbased, carbonated calcium sulfonate, 0.60% poly (propoxy-ethoxy) alcohol, 90.6% of the product of Example 1 and 0.30% of alkylated diphenylamine.

EXAMPLE II

An additive concentrate for two-cycle engine lubricants contains 8.45% of basic calcium sulfonate, 1.01% overbased, carbonated calcium sulfonate, 0.68% poly (propoxy-ethoxy) alcohol, 72.6% of the product of example I, 16.89% of basic methylene-coupled calcium alkyl phenate and 0.34% of alkylated diphenyl amine As is well known to those skilled in the art, two-cycle engine lubricating oils are often added directly to the fuel to form a mixture of a lubricant and fuel which is then introduced into the engine cylinder. Such lubricant-fuel mixtures are within the scope of this invention. Such lubricant-fuel mixtures generally contain a major amount of fuel and a minor amount of lubricant, more often at least about 10, preferably about 15, more preferably about 20 up to about 100, more preferably up to about 50 parts of fuel per 1 part of lubricant.

The fuels used in two-cycle engines are well known to those skilled in the art and usually contain a major portion of a normally liquid fuel such as hydrocarbonaceous petroleum distillate fuel (e.g., motor gasoline as defined by ASTM Specification D-439-73). Such fuels can also contain non-hydrocarbonaceous materials such as alcohols, ether, organo-nitro compounds and the like (e.g., methanol, ethanol, diethyl ether, methyl ethyl ether, nitromethane) are also within the scope of this invention as are liquid fuels derived from vegetable or mineral sources such as corn, alfalfa, shale and coal. Mixtures of fuels, such as mixtures of gasoline and alcohol, for example, methanol or ethanol are among the useful fuels.

Examples of fuel mixtures are combinations of gasoline and ethanol, diesel fuel and ether, gasoline and nitromethane, etc. Particularly preferred is gasoline, that is, a mixture of hydrocarbons having an ASTM boiling point of 60° C. at the 10% distillation point to about 205° C. at the 90% distillation point.

Natural gas is also useful as a fuel for two-cycle engines.

Two-cycle fuels also contain other additives which are well known to those of skill in the art. These may include ethers, such as ethyl-t-butyl ether, methyl-t-butyl ether and the like, alcohols such as ethanol and methanol, lead scavengers such as halo-alkanes (e.g., ethylene dichloride and ethylene dibromide), dyes, cetane improvers, antioxidants such as 2,6 di-tertiary-butyl-4-methylphenol, rust inhibitors, such as alkylated succinic acids and anhydrides, bacteriostatic agents, gum inhibitors, metal deactivators, demulsifiers, upper cylinder lubricants, anti-icing agents and the like. The invention is useful with lead-free as well as lead-containing fuels.

Two cycle engine lubricating oils of this invention are illustrated in the following examples. All parts and percentages are by weight and unless indicated otherwise, amounts of components are given on a diluent-free basis. Amounts of components from the preceding Examples are given as prepared and are not adjusted for oil content.

TABLE III

| Product of Example Number: | EXAMPLE: A | B | C | D | E | F | G | H | I | J | K | L | M | N | O | P | Q | R | S | T |
|---|---|---|---|---|---|---|---|---|---|---|---|---|---|---|---|---|---|---|---|---|
| 1 | 4 | | | | | | | | | | | | | | | | | | | |
| 1 | | 6 | | | | | | | | | | | | | | | | | | |
| 1 | | | 9 | | | | | | | | | | | | | | | | | |
| 4 | | | | 3 | | | | | | | | | | | | | | | | |

TABLE III-continued

| Product of Example Number: | EXAMPLE: A | B | C | D | E | F | G | H | I | J | K | L | M | N | O | P | Q | R | S | T |
|---|---|---|---|---|---|---|---|---|---|---|---|---|---|---|---|---|---|---|---|---|
| 5 | | | | | 6 | | | | | | | | | | | | | | | |
| 2 | | | | | | 6 | | | | | | | | | | | | | | |
| 13 | | | | | | | 6 | | | | | | | | | | | | | |
| 14 | | | | | | | | 6 | | | | | | | | | | | | |
| 3 | | | | | | | | | 6 | | | | | | | | | | | |
| 7 | | | | | | | | | | 6 | | | | | | | | | | |
| 6 | | | | | | | | | | | 6 | | | | | | | | | |
| 2 | | | | | | | | | | | | 3 | | | | | | | | |
| 4 | | | | | | | | | | | | | 1.5 | | | | | | | |
| 9 | | | | | | | | | | | | | | 4 | | | | | | |
| 9 | | | | | | | | | | | | | | | 2 | | | | | |
| 36 | | | | | | | | | | | | | | | | 6 | | | | |
| 36 | | | | | | | | | | | | | | | | | 4 | | | |
| 4 | | | | | | | | | | | | | | | | | | 1 | | |
| 4 | | | | | | | | | | | | | | | | | | | 2 | |
| 9 | | | | | | | | | | | | | | | | | | | | 2 |

Each of the lubricating oil compositions in this table contains 0.04% of poly (propoxy-ethoxy) alcohol, 0.2% of a methylene-coupled alkylated naphthalene as described in U.S. Pat. No. 4,753,745, 0.25% of a basic calcium sulfonate, 0.035% of an overbased, carbonated calcium sulfonate and 15% of a hydrocarbon solvent (Stoddard Solvent-Defined in ASTM D-484-52), an amount of a component as given in the table and two-cycle mineral oil basestock sufficient to make the total composition 100%

EXAMPLE U

A chain saw lubricating oil is made up of 0.22% of a polymer of alkyl fumarate, vinyl acetate and vinyl ethyl ether, 8% Stoddard Solvent, 0.25% of basic calcium sulfonate, 0.024% of overbased carbonated calcium sulfonate, 0.04% of poly (propoxy-ethoxy) alcohol, 0.017% of alkylated diphenyl amine, 4.3% of the product of Example 2 and sufficient mineral oil basestock comprising 88% 600 neutral oil and 12% 150 Bright Stock to bring the total up to 100%.

EXAMPLE V

The oil composition of Example A replacing 0.25% of basic calcium sulfonate with base oil.

EXAMPLE W

The oil composition of Example A increasing the amount of basic calcium sulfonate to 0.5%.

EXAMPLE X

A lubricating oil for two-cycle engines is prepared containing 0.2% of a methylene coupled alkylated naphthalene, 0.57% of the reaction product of polybutene substituted succinic anhydride with ethylene polyamines, 0.5% of basic calcium sulonate, 0.35% of overbased, carbonated calcium sulfonate, 0.035% of overbased carbonated calcium sulfonate, 0.04% of poly (propoxy-ethoxy) alcohol, 3% of the product of Example 1 and 15% Stoddard Solvent and sufficient mineral oil basestock to bring the total to 100%.

EXAMPLE Y

A lubricating oil for two-cycle engines is prepared containing 0.2% of a methylene coupled alkylated naphthalene, 0.57% of the reaction product of polybutene substituted succinic anhydride with ethylene polyamines, 0.035% of overbased, carbonated calcium sulfonate, 0.04% of poly (propoxy-ethoxy) alcohol, 3% of the product of Example 1 and 15% Stoddard Solvent and sufficient mineral oil basestock to bring the total to 100%.

EXAMPLE Z

A lubricating oil for two-cycle engines is prepared containing 15% of polybutene (Mn approx 1000) containing primarily isobutene repeating units, 15% polybutene polymer (Indopol L-14), 10% kerosene and 6.62% of the additive concentrate of EXAMPLE I and sufficient mineral oil basestock to bring the total to 100%.

EXAMPLE AA

A lubricating oil for two-cycle engines is prepared containing 15% of polybutene (Mn approx 1000) containing primarily isobutene repeating units, 15% polybutene polymer (Indopol L-14), 10% kerosene and 5.92% of the additive concentrate of EXAMPLE II and sufficient mineral oil basestock to bring the total to 100%.

As mentioned hereinabove, this invention also relates to methods for lubricating two-cycle engines. In one embodiment, a lubricant for two-cycle engines of this invention is added to a fuel and the engine is operated employing this lubricant-fuel mixture as the operating fuel.

With many engines, particularly larger engines, the fuel and lubricant are supplied separately to the engine. The lubricant may be supplied to the fuel intake system either before or after the carburetor and before the fuel is drawn into the combustion chamber. At least some mixing of the lubricant and fuel takes place under these conditions.

In another embodiment, a lubricant of this invention is supplied to the operating engine separately from the fuel. This may be accomplished by injecting lubricant into the crankcase, then some of the lubricant is drawn into the combustion chamber. Fuel is generally injected directly into the combustion chamber.

In both cases, the lubricant is consumed during combustion and a fresh lubricant is supplied with each fuel charge.

Two-cycle lubricating oil compositions were evaluated employing the Yamaha Y-350 M2 Test Procedure. The test engine is a 347 cm3 Yamaha RD-350B twin-cylinder air-cooled motorcycle engine. The test is primarily designed to evaluate ring-sticking and piston skirt deposits. Spark plug fouling, combustion chamber deposits and exhaust port blockage are also evaluated. A separate oil is evaluated in each cylinder allowing a direct comparison of a test oil with a standard, i.e., reference oil. Typically, fuel:oil ratio is about 50:1 although this may be varied. The test procedure involves a 25 minute 6000 rpm (revolutions per minute), 8.5 horsepower cycle and a 5 minute idle cycle repeated five times with a 60 minute minimum shutdown after each 150 minutes of running time, then repeating until 20 hours running time is completed.

Another test to evaluate piston skirt varnish and ring sticking performance of two-cycle engine lubricants is the West Bend 10 Hour Deposit Test. The test engine is a gasoline fueled, single cylinder, 134 $cm^3$ air-cooled utility two-cycle engine. The engine is operated employing the test lubricant at 50:1 fuel:oil ratio for 10 hours at 5000 rpm, 4.7 horsepower. Numerical ratings are assigned for piston skirt varnish, ring sticking, exhaust port blockage and piston undercrown deposits.

Lubricating oil compositions of this invention when evaluated on the above tests generally provide performance at least comparable to commercially available two-cycle lubricants and often exceed the performance of these commercial oils.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricant for two-cycle engines comprising a major amount of at least one oil of lubricating viscosity and a minor amount of at least one compound of the general formula $$A^{y-}M^{y+} \qquad \text{(I)}$$

wherein M represents one or more alkali or alkaline earth metal ions, y is the total valence of all M and A represents one or more anion containing groups having a total of about y individual anionic moieties and each anion containing group is a group of the formula (II)

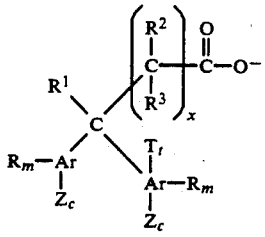

wherein T is selected from the group consisting of (V)

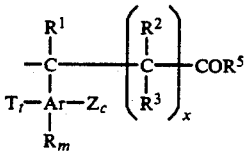

-continued (VI)

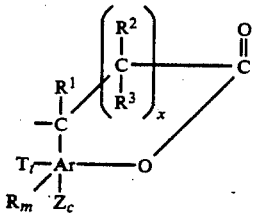

wherein each $R^5$ is independently selected from $O^-$ and $OR^6$ wherein $R^6$ is H or alkyl and each t is independently 0 or 1, wherein T is as hereinbefore defined and wherein each Ar is independently an aromatic group of from 4 to about 30 carbon atoms having from 0 to 3 optional substituents selected from the group consisting of polyalkoxyalkyl, lower alkoxy, nitro, halo or combinations of two or more of said optional substituents, each R is independently a hydrocarbyl group, $R^1$ is H or a hydrocarbyl group, $R^2$ and $R^3$ are each independently H or a hydrocarbyl group, each m is independently 0 or an integer ranging from 1 to about 10, x ranges from 0 to about 8, and each Z is independently OH, $(OR^4)_bOH$ or $O^-$ wherein each $R^4$ is independently a divalent hydrocarbyl group and b is a number ranging from 1 to about 30 and c ranges from 0 to about 3 with the proviso that when t in Formula (II)=0, or when T is Formula (V), then c is not 0, provided that the sum of m, c and t does not exceed the valences of the corresponding Ar terminating when t=0.

2. A lubricant according to claim 1 wherein t in Formula (II) is 0.

3. A lubricant according to claim 1 wherein each of $R^1$, $R^2$ and $R^3$ is independently hydrogen or a lower alkyl or alkenyl group.

4. A lubricant according to claim 1 wherein M is sodium or lithium.

5. A method of operating a two-cycle internal combustion engine comprising lubricating said engine by introducing into the fuel intake system a lubricant according to claim 1.

6. A lubricant according to claim 1 wherein t in Formula (II) is 1.

7. A lubricant according to claim 6 wherein T is a group having the structure given by Formula (V).

8. A lubricant according to claim 6 wherein T is a group having the structure given by Formula (VI).

9. The lubricant of claim 6 having from 1 to about 3 additional groups selected from Formula (V) and Formula (VI).

10. A lubricant according to claim 1 having at least one R containing from 4 to about 750 carbon atoms.

11. A lubricant according to claim 10 wherein each R is independently an aliphatic group.

12. A lubricant according to claim 1 wherein m equals 1 and R is an alkyl or alkenyl group.

13. A lubricant according to claim 12 wherein R contains from 8 to about 24 carbon atoms.

14. A lubricant according to claim 12 wherein R contains from 30 to about 100 carbon atoms and is derived from homopolymerized and interpolymerized $C_{2-10}$ olefins.

15. A lubricant according to claim 14 wherein the olefins are 1-olefins.

16. A lubricant according to claim 15 wherein the 1-olefins are ethylene, propylene, butenes and mixtures thereof.

17. A lubricant according to claim 12 wherein R contains from 12 to about 50 carbon atoms.

18. A lubricant according to claim 17 wherein at least one Ar is a member of the group consisting of a benzene nucleus, a lower alkylene bridged benzene nucleus or a naphthalene nucleus.

19. A lubricant according to claim 18 wherein each Z is OH, m and c are each one, X is 0, and Ar has no optional substituents, and $R^1$=H.

20. A lubricant according to claim 1 wherein each Ar is independently a single ring aromatic group, a fused ring aromatic group or a linked aromatic group.

21. A lubricant according to claim 20 wherein at least one Ar is a linked aromatic group corresponding to the formula $$ar\text{-}(L\text{-}ar)_w\text{-}$$

wherein each ar is a single ring or a fused ring aromatic nucleus of 4 to about 12 carbons, w is an integer ranging from 1 to about 20 and each L is independently selected from the group consisting of carbon to carbon single bonds between ar nuclei, ether linkages, sulfide linkages, polysulfide linkages, sulfinyl linkages, sulfonyl linkages, lower alkylene linkages, lower alkylene ether linkages, lower alkylene sulfide and/or polysulfide linkages, amino linkages derived from oxo- or keto- carboxylic acids of the formula

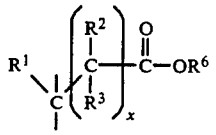

wherein each of $R^1$, $R^2$ and $R^3$ is independently alkyl or alkenyl, or H, $R^6$ is H or an alkyl group and x is an integer ranging from 0 to about 8, and mixtures of such linkages.

22. A lubricant according to claim 1 wherein at least one Z is —OH.

23. A lubricant according to claim 22 wherein each c is 1 and one Z is $O^-$.

24. A lubricant according to claim 1 wherein at least one Z is $(OR^4)_bOH$.

25. A lubricant according to claim 18 wherein $R^4$ is a lower alkylene group.

26. A lubricant-fuel mixture for two-cycle engines comprising a major amount of a normally liquid fuel and a minor amount of the lubricant of claim 1.

27. A mixture according to claim 26 wherein the fuel comprises gasoline.

28. A method of operating a two-cycle internal combustion engine comprising fueling said engine with a mixture according to claim 27.

29. A mixture according to claim 26 wherein the fuel comprises alcohol.

30. A method of operating a two-cycle internal combustion engine comprising fueling said engine with a mixture according to claim 29.

31. A mixture according to claim 26 wherein the fuel comprises a mixture of gasoline and ethanol.

32. A method of operating a two-cycle internal combustion engine comprising fueling said engine with a mixture according to claim 31.

33. A mixture according to claim 26 wherein the oil of lubricating viscosity comprises mineral oil.

34. A method of comprising a two-cycle internal combustion engine comprising fueling said engine with a mixture according to claim 33.

35. A mixture according to claim 26 wherein the oil of lubricating viscosity comprises at least one synthetic oil.

36. A method of operating a two-cycle internal combustion engine comprising fueling said engine with a mixture according to claim 26.

37. A lubricant for two-cycle engines comprising a major amount of at least one oil of lubricating viscosity, and a minor amount of at least one compound of the formula

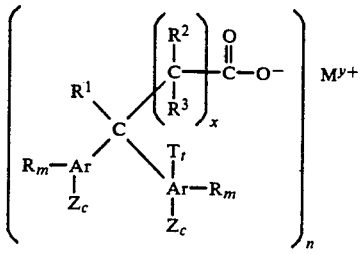

(II)

wherein M represents one or more alkali or alkaline earth metal ions, y is the total valence of all M, n is a number depending on the value of y, n times the number of anionic moieties in the corresponding parenthetical group is about equal to y, each Ar is independently an aromatic group of the formula

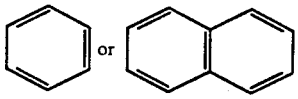

wherein T is selected from the group consisting of

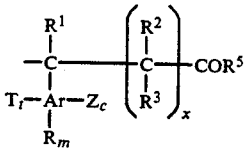

(V)

or

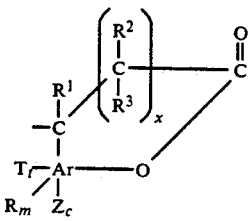

(VI)

wherein each $R^5$ is independently selected from $O^-$ and $OR^6$ wherein $R^6$ is H or alkyl and each t is independently 0 or 1, each Ar has 0 or 1 optional substituents selected from the group consisting of lower alkyl, lower alkoxy, polyalkoxyalkyl, nitro or halo, T is as hereinbefore defined, each R is independently an aliphatic hydrocarbyl group wherein at least one R has at least 6 carbon atoms, $R^1$ is H or an aliphatic group, $R^2$ and $R^3$ are each independently H or an aliphatic group, each m is independently an integer ranging from 1 to about 3, x ranges from 0 to about 8, and each Z is independently OH, $(OR^4)_bOH$ or $O^-$ wherein each $R^4$ is independently a divalent hydrocarbyl group and b is a number ranging from 1 to about 30 and c ranges from 0 to about 2 with the proviso that when t in Formula (II)=0, or when T is Formula (V), then c is not 0 provided that the sum of m, c and t does not exceed the unsatisfied valences of the corresponding Ar terminating when t=0.

38. A lubricant according to claim 37 wherein t in Formula (II) is 0.

39. A lubricant, according to claim 37 wherein $R^1$ is H or a lower alkyl group, $R^2$ and $R^3$ are independently H or a lower alkyl group and x is 0, 1 or 2.

40. A lubricant according to claim 37 wherein M is sodium or lithium.

41. A method of operating a two-cycle internal combustion engine comprising lubricating said engine by introducing into the fuel intake system a lubricant according to claim 37.

42. A lubricant according to claim 37 wherein t in Formula (II) is 1.

43. A lubricant according to claim 42 wherein T is a group having the structure given by Formula (V).

44. A lubricant according to claim 42 wherein T is a group having the structure given by Formula (VI).

45. A lubricant according to claim 37 wherein at least one R contains from 8 to about 100 carbon atoms and m is 1 or 2.

46. A lubricant according to claim 45 wherein R is a substantially saturated aliphatic group.

47. A lubricant according to claim 45 wherein R contains from about 8 to about 24 carbon atoms and each m is 1.

48. A lubricant according to claim 45 wherein R contains at least about 30 carbon atoms and m is 1.

49. A lubricant according to claim 45 wherein R contains from 12 to about 50 carbon atoms and m is 1.

50. A lubricant according to claim 37 wherein Ar is

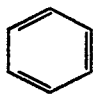

and Z is OH.

51. A lubricant according to claim 38 wherein c is 1.

52. A lubricant-fuel mixture for two-cycle engines comprising a major amount of a normally liquid fuel and a minor amount of the lubricant of claim 37.

53. A method of operating a two-cycle internal combustion engine comprising fueling said engine with a mixture according to claim 52.

54. A lubricant for 2-cycle engines comprising a major amount of at least one oil of lubricating viscosity, and at least one compound of the formula

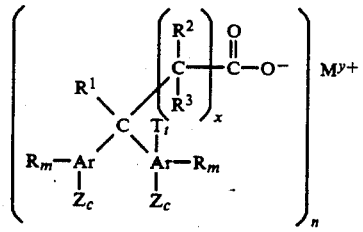

(II)

wherein M represents one or more alkali or alkaline earth metal ions, y is the valence of all M, and n is a number depending on the value of y, n times the number of anionic moieties in the corresponding parenthetical group is about equal to y, wherein T is selected from the group consisting of

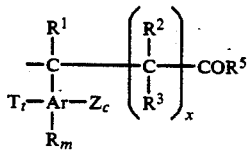

(V)

or

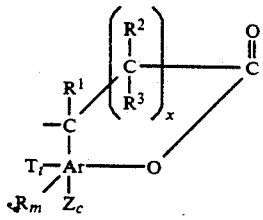

(VI)

wherein each $R^5$ is independently selected from $O^-$ and $OR^6$ wherein $R^6$ is H or alkyl and each t is independently 0 or 1, wherein each Ar is independently an aromatic group of from 4 to about 30 carbon atoms having from 0 to 3 optional substituents selected from the group consisting of polyalkoxyalkyl, lower alkoxy, nitro, halo or combinations of two or more of said optional substituents, wherein T is as hereinbefore defined, each R is independently a hydrocarbyl group, at least one Ar is an aromatic group of the formula $$ar\text{-}(L\text{-}ar)_w$$

wherein each ar is a single ring or a fused ring aromatic nucleus of 4 to 12 carbons, w is an integer ranging from 1 to about 20 and each L is independently selected from the group consisting of carbon to carbon single bonds between ar nuclei, ether linkages, sulfide linkages, polysulfide linkages, sulfinyl linkages, sulfonyl linkages, lower alkylene linkages, lower alkylene ether linkages, lower alkylene sulfide and/or polysulfide linkages, amino linkages, linkages derived from oxo- or keto-carboxylic acids of the formula

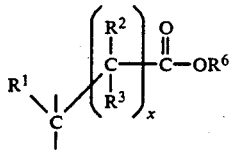

wherein each of $R^1$, $R^2$ and $R^3$ is independently lower alkyl or H, $R^6$ is H or an alkyl group and x is an integer ranging from 0 to about 8, and mixtures of such linkages, at least one ar has a substituent R wherein each R is independently alkyl or alkenyl, each Z is OH, $(OR^4)_bOH$ or $O^-$, $R^4$ is an alkylene group, and b ranges from 1 to about 10, each of $R^1$, $R^2$ and $R^3$ is independently H or lower alkyl, x ranges from 0 to 3, m ranges from 1 up to about 10 and c is a number ranging from 0 to about 3 provided that when t in Formula (II)=0, or when T is Formula (V), then c is not zero provided that the sum of m c and t does not exceed the unsatisfied valences of the corresponding Ar terminating when t=0.

55. A lubricant according to claim 54 wherein t in Formula (II) is 0.

56. A lubricant according to claim 54 wherein L is selected from the group consisting of ether linkages, sulfide and/or polysulfide linkages, lower alkylene linkages or carbon to carbon single bonds between ar nuclei.

57. A lubricant according to claim 54 wherein at least one ar is a group of the formula

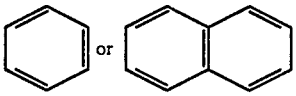

and w is 1, 2 or 3.

58. A lubricant according to claim 54 wherein each ar has one substituent R having from 4 to about 100 carbon atoms and there are substantially no optional substituents on ar.

59. A method of operating a two-cycle internal combustion engine comprising lubricating said engine by introducing into the fuel intake system a lubricant according to claim 54.

60. A lubricant according to claim 54 wherein t in Formula (II) is 1.

61. A lubricant according to claim 60 wherein T is a group having the structure given by Formula (V).

62. A lubricant according to claim 60 wherein T is a group having the structure given by Formula (VI).

63. A lubricant according to claim 54 wherein M is an alkali metal ion and Z is selected from OH and $O^-$.

64. A lubricant according to claim 63 wherein at least one Z is OH and at least one Z is $O^-$.

65. A lubricant according to claim 63 wherein the metal is lithium or sodium.

66. A lubricant-fuel mixture for two-cycle engines comprising a major amount of a normally liquid fuel and a minor amount of the lubricant of claim 54.

67. A method of operating a two-cycle internal combustion engine comprising fueling said engine with a mixture according to claim 66.

68. A lubricant for two-cycle engines comprising a major amount of at least one oil of lubricating viscosity and at least one compound of the formula

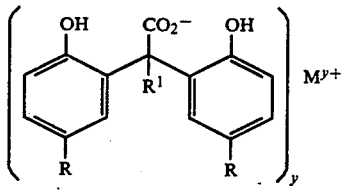

wherein M represents one or more alkali or alkaline earth metal ions, y is the total valence of all M, $R^1$ is H or an alkyl or alkenyl group containing from 1 to about 20 carbon atoms and each R is independently a hydrocarbyl group containing from 4 to about 300 carbon atoms.

69. A lubricant according to claim 68 wherein each R independently contains from 12 to about 24 carbon atoms.

70. A lubricant according to claim 68 wherein each R independently contains an average of at least 30 carbon atoms.

71. A lubricant according to claim 68 wherein each R contains from 12 to about 50 carbon atoms.

72. A lubricant according to claim 68 wherein M is lithium or sodium.

73. A method of operating a two-cycle internal combustion engine comprising lubricating said engine by introducing into the fuel intake system a lubricant according to claim 68.

74. A lubricant according to claim 68 wherein each R is derived from polymerized of interpolymerized $C_{2-10}$ olefins.

75. A lubricant according to claim 74 wherein the olefins are 1-olefins.

76. A lubricant according to claim 75 wherein the olefins are selected from the group consisting of propylene, butenes or ethylene.

77. A lubricant according to claim 76 wherein the olefin is propylene and R has a number average molecular weight ranging from 300 to about 300.

78. A lubricant-fuel mixture for two-cycle engines comprising a major amount of a normally liquid fuel and a minor amount of the lubricant of claim 68.

79. A method of operating a two-cycle internal combustion engine comprising fueling said engine with a mixture according to claim 78.

80. An additive concentrate for preparing two-cycle engine lubricants comprising from about 20 to about 90 percent by weight of a substantially inert diluent and from about 10 to about 80% by weight of at least one compound of the general formula $$A^{y-}M^{y+} \quad (I)$$

wherein M represents one or more alkali or alkaline earth metal ions, y is the total valence of all M and A represents one or more anion containing groups having a total of about y individual anionic moieties and each anion containing group is a group of the formula (II)

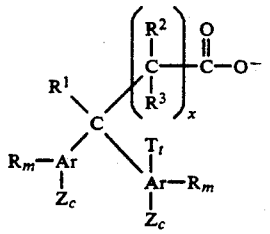

wherein T is selected from the group consisting of (V)

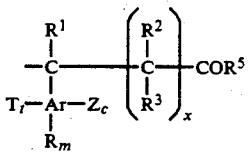

or

-continued (VI)

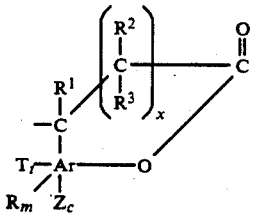

wherein each $R^5$ is independently selected from $O^-$ and $OR^6$ wherein $R^6$ is H or alkyl and each t is independently 0 or 1, wherein each Ar is independently an aromatic group of from 4 to about 30 carbon atoms having from 0 to 3 optional substituents selected from the group consisting of polyalkoxyalkyl, lower alkoxy, nitro, halo or combinations of two or more of said optional substituents, wherein each T is as hereinbefore defined, each R is independently a hydrocarbyl group, $R^1$ is H or a hydrocarbyl group, $R^2$ and $R^3$ are each independently H or a hydrocarbyl group, each m is independently 0 or an integer ranging from 1 to about 10, x ranges from 0 to about 8, and each Z is independently OH, $(OR^4)_bOH$ or $O^-$ wherein each $R^4$ is independently a divalent hydrocarbyl group and b is a number ranging from 1 to about 30 and c ranges from 0 to about 3 with the proviso that when t in Formula (II)=0, or when T is Formula V, then c is not 0 provided that the sum of m, c and t does not exceed the unsatisfied valences of the corresponding Ar terminating when t=0.

* * * * *